US006526892B2

(12) United States Patent
Heitmann et al.

(10) Patent No.: US 6,526,892 B2
(45) Date of Patent: Mar. 4, 2003

(54) ARTILLERY CARTRIDGE HAVING AN INTERNAL CONDUCTOR ARRANGEMENT

(75) Inventors: Thomas Heitmann, Unterlüss (DE); Michael Vagedes, Hermannsburg (DE); Michael Imdahl, Baven (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/051,287

(22) Filed: Jan. 22, 2002

(65) Prior Publication Data

US 2002/0108525 A1 Aug. 15, 2002

(30) Foreign Application Priority Data

Jan. 20, 2001 (DE) ..... 101 02 624

(51) Int. Cl.[7] ..... F42C 19/06; F42C 11/04

(52) U.S. Cl. ..... 102/472; 89/6; 89/6.5; 102/430

(58) Field of Search ..... 102/472, 430, 102/439, 469, 470; 89/6, 6.5

(56) References Cited

U.S. PATENT DOCUMENTS 4,852,457 A * 8/1989 Schlegel et al. ..... 89/6.5
5,078,051 A * 1/1992 Amundson ..... 102/206
5,097,765 A * 3/1992 Ziemba ..... 102/218
5,936,189 A * 8/1999 Lubbers ..... 102/439
2002/0005136 A1 * 1/2002 Weise et al. ..... 102/472

* cited by examiner

*Primary Examiner*—Charles T. Jordan
*Assistant Examiner*—Susan C. Alimenti
(74) *Attorney, Agent, or Firm*—Venable; Norman N. Kunitz

(57) ABSTRACT

A cartridge includes a cartridge case having a cartridge base; a projectile having a rearward portion received by the cartridge case; a propellant primer disposed in the cartridge case and extending along the longitudinal cartridge axis; an electrically programmable projectile fuze disposed in the projectile; an electrode disposed at the cartridge base; a plug mounted on the propellant primer at a frontal end thereof; a first contact carried by the plug; a first conductor extending in the propellant primer and connecting the first contact with the electrode; a socket, formed on the rearward portion of the projectile, receives and surrounds the plug; a second contact carried by the socket and being in electric contact with the first contact; and a second conductor extending in the projectile and connecting the second contact with the projectile fuze.

9 Claims, 2 Drawing Sheets

ARTILLERY CARTRIDGE HAVING AN INTERNAL CONDUCTOR ARRANGEMENT

CROSS REFERENCE TO RELATED APPLICATION

This application claims the priority of German Application No. 101 02 624.2 filed Jan. 20, 2001, which is incorporated herein by reference.

BACKGROUND OF THE INVENTION

The invention relates to a cartridge having a cartridge case and a projectile. The cartridge case accommodates a propellant primer extending in the direction of the longitudinal cartridge axis. The projectile houses an electrically programmable projectile fuze connected by at least one electric conductor with an electrode disposed at the base of the cartridge case.

A cartridge of the above-outlined type is conventional and is disclosed, for example, in German Patent No. 41 02 287. In this known arrangement the electric connection between the projectile fuze and the electrode disposed at the base of the propellant primer is maintained by the electrically insulated propellant primer itself as well as an electric cable passing through the propellant powder. It is a disadvantage of such a cartridge that because of the usual handling of the cartridge which involves shaking motions, the powder grains often damage the cable, for example, by friction effect.

SUMMARY OF THE INVENTION

It is an object of the invention to provide a cartridge with a programmable projectile fuze which is simple to manufacture and in which damages of the electric conductors between the projectile fuze and the electrode arranged at the cartridge bottom cannot occur either during the introduction of the propellant powder into the cartridge case or as a result of the usual handling of the finished cartridge.

This object and others to become apparent as the specification progresses, are accomplished by the invention, according to which, briefly stated, the cartridge includes a cartridge case having a cartridge base; a projectile having a rearward portion received by the cartridge case; a propellant primer disposed in the cartridge case and extending along the longitudinal cartridge axis; an electrically programmable projectile fuze disposed in the projectile; an electrode disposed at the cartridge base; a plug mounted on the propellant primer at a frontal end thereof; a first contact carried by the plug; a first conductor extending in the propellant primer and connecting the first contact with the electrode; a socket, formed on the rearward portion of the projectile, receiving and surrounding the plug; a second contact carried by the socket and being in electric contact with the first contact; and a second conductor extending in the projectile and connecting the second contact with the projectile fuze.

The invention is thus essentially based on the principle to arrange the propellant primer such that it extends to the rear terminus of the projectile and has, on its side facing the projectile, a contact plug surrounded by a socket mounted in the projectile. At least one contact of the plug is connected by a first conductor portion of the timing cable. The first conductor portion passes through the propellant primer and is connected with a preferably annular electrode situated at the cartridge base, in the lower portion of the propellant primer. At least one contact situated in the socket presses against the contact of the plug and is, in turn, connected with the projectile fuze by means of a second conductor portion of the timing cable. The second conductor portion extends within the projectile.

The above-outlined construction ensures that the propellant powder grains do not touch the timing cable and the electric contacts. Also, an inexpensive rearward projectile support at the rear is ensured by the propellant primer.

The invention further has the advantage that during assembly of the cartridge the electric connection between the two conductor portions of the timing cable occurs in a "self-finding" manner. For this purpose the contacts are designed such that a contacting occurs in relation to the longitudinal cartridge axis, independently from the momentary angular position. This may be accomplished by designing the contacts of the socket and/or the plug as annular contacts.

The cap-shaped form of the preferably ejectable socket made, for example, of a synthetic material, ensures a free space in the central region of the rear portion of the projectile for accommodating a central light tracer unit. Further, the socket ensures that no propellant powder may gain access between the plug and the tracer unit to thus prevent an ignition of the tracer unit by the propellant powder grains or grain residues.

For connecting the projectile fuze with a plurality of timing cables, a plurality of annular contacts are provided in the cap-shaped socket whose number corresponds to that of the timing cables. In such a case the plug is of stepped configuration, and with each annular contact in the socket a separate step in the plug is associated. The plug steps have different diameters and each is provided with a respective contact. By selecting the axial length of the individual steps, a tolerance compensation in the longitudinal direction between the annular contacts and the plug is ensured in a simple manner.

DESCRIPTION OF THE PREFERRED EMBODIMENT

Figure 1:
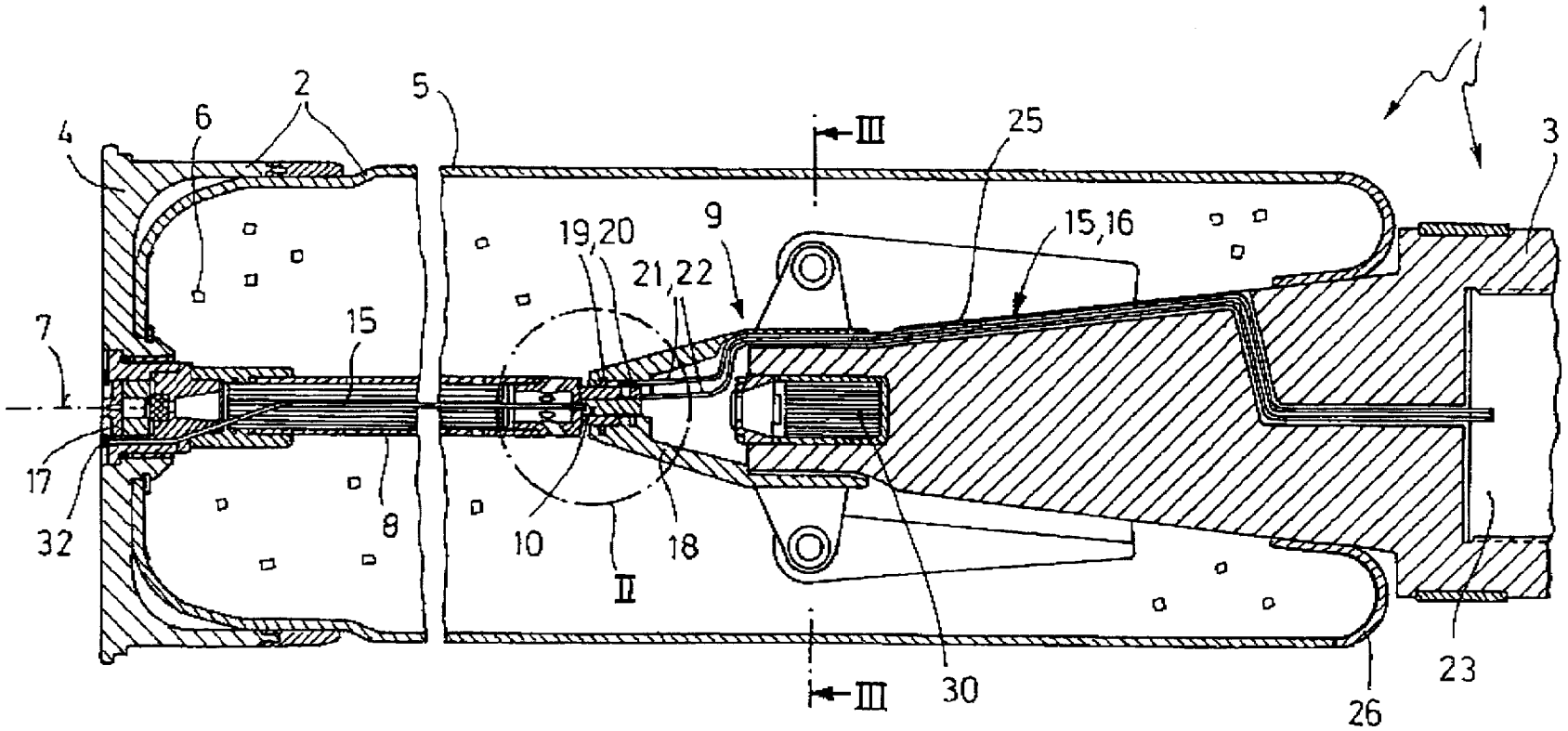
FIG. 1 is an axial sectional view of a cartridge incorporating the invention.

FIG. 1 illustrates a large-caliber projectile 1 for being fired from a tank cannon. The cartridge 1 is composed of a cartridge case 2 and an only partially shown projectile 3 accommodating a tracer unit 30. The cartridge case 2 which accommodates the propellant powder 6 includes a cartridge base 4 and a case jacket 5 made of a combustible material.

Figure 2:
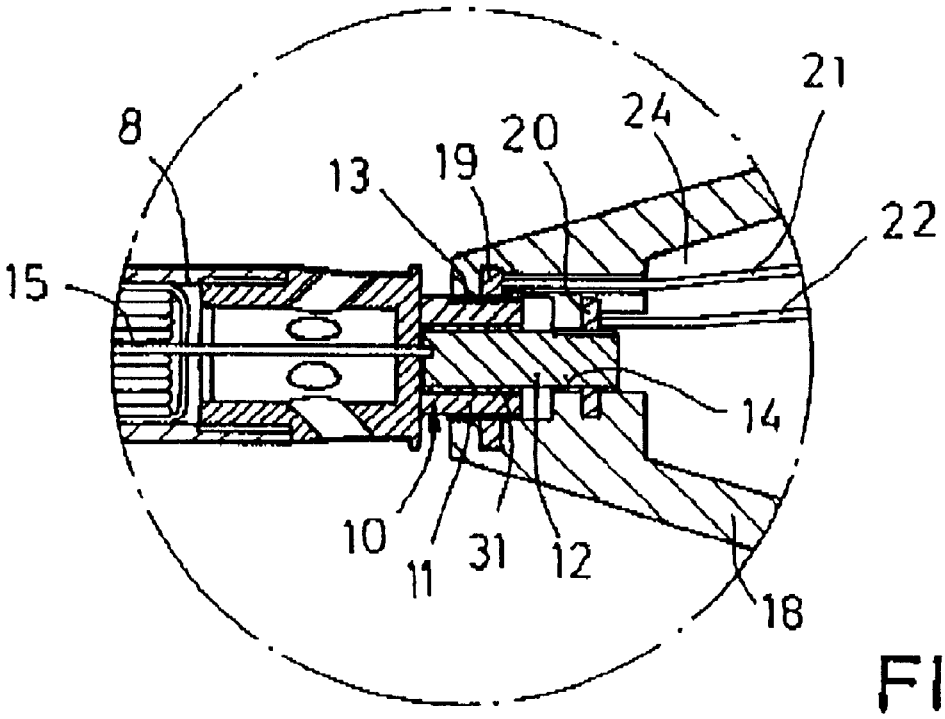
FIG. 2 is an enlarged sectional view of the inset designated at II in FIG. 1.
Figure 3:
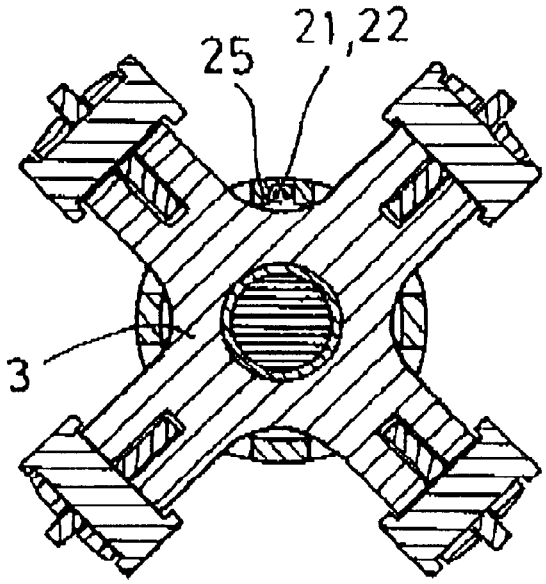
FIG. 3 is a sectional view taken along line III—III of FIG. 1.

Also referring to FIG. 2, a propellant primer 8 extending along the longitudinal cartridge axis 7 is connected with the cartridge base 4 and has a contact plug 10 at its end oriented towards the projectile rearward end 9 of the projectile 3. The plug 10 has two stepped portions 11 and 12 separated by an electrically insulating sleeve 31. The stepped portions 11 and 12 which are connected to contacts 13, 14, have unlike diameters and have a predetermined length. The contacts 13, 14 are, in turn, connected by two electric conductor portions which pass through the propellant primer 8 and which form part of two timing cables 15, 16 having two electrodes situated on the primer bottom 17. One of the two electrodes which is designated at 32 is annular and is arranged in the lower part of the propellant primer whereas the other of the two electrodes is constituted by the ground of the propellant primer bottom 17.

At its end oriented towards the plug 10 the projectile 3 has a conical, cap-like socket 18 which surrounds the plug 10 and which has two spring-loaded annular contacts 19, 20 electrically connected with the two contacts 13, 14 of the plug 10. The annular contacts 19, 20 are connected via two conductor portions 21, 22 of the timing cable 15, 16 with a projectile fuze 23. The two conductor portions 21, 22 are arranged in the free spaces 24 of the socket 18 and extend to the projectile fuze 23 in a cable well 25 filled with a synthetic mass or an adhesive.

In the region of the plastic socket 18 the conductor portions 21, 22 may also be integrated with the socket 18 as the latter is manufactured by casting.

The attachment of the socket 18 to the projectile 3 may be effected by press-fitting, by an adhesive or by a snap-in connection.

During the assembly of the cartridge 1, the projectile 3 is, together with the socket 18, inserted into the cartridge case 2 provided with the propellant primer 8. In the course of such an assembly step the socket 18 is pushed over the plug 10 so that the annular contacts 19, 20 are pressed against the plug contacts 13, 14. Subsequently, in a known manner, the case lid 26 fastened to the projectile 3 is conventionally united with the case jacket 5 of the cartridge case 2. The case 2 is filled with the propellant powder 6 through a non-illustrated window provided in the case jacket 5 or the case lid 26.

It will be understood that the above description of the present invention is susceptible to various modifications, changes and adaptations, and the same are intended to be comprehended within the meaning and range of equivalents of the appended claims.

What is claimed is:

1. A cartridge having a longitudinal axis; said cartridge comprising (a) a cartridge case having a cartridge base;

(b) a projectile having a rearward portion received by said cartridge case;

(c) a propellant primer disposed in said cartridge case and extending along said longitudinal axis; said propellant primer having a frontal end oriented toward said rearward portion;

(d) an electrically programmable projectile fuze disposed in said projectile;

(e) an electrode disposed at said cartridge base;

(f) a plug mounted on said propellant primer at said frontal end thereof;

(g) a first contact carried by said plug;

(h) a first conductor extending in said propellant primer and connecting said first contact with said electrode;

(i) a socket formed on said rearward portion of said projectile; said socket receiving and surrounding said plug;

(j) a second contact carried by said socket and being in electric contact with said first contact; and (k) a second conductor extending in said projectile and connecting said second contact with said projectile fuze.

2. The projectile as defined in claim 1, wherein said socket is conical.

3. The projectile as defined in claim 1, wherein said socket is of a synthetic material.

4. The projectile as defined in claim 1, wherein said first contact is annular.

5. The projectile as defined in claim 1, wherein said second contact is annular.

6. A cartridge having a longitudinal axis; said cartridge comprising (a) a cartridge case having a cartridge base;

(b) a projectile having a rearward portion received by said cartridge case;

(c) a propellant primer disposed in said cartridge case and extending along said longitudinal axis; said propellant primer having a frontal end oriented toward said rearward portion;

(d) an electrically programmable projectile fuze disposed in said projectile;

(e) two electrodes disposed at said cartridge base;

(f) a plug mounted on said propellant primer at said frontal end thereof; said plug having first and second stepped portions of different diameters;

(g) an insulating body separating said first and second stepped portions from one another;

(h) first and second contacts carried by said first and second stepped portions, respectively;

(i) first and second conductors extending in said propellant primer and connecting said first and second contacts with respective said electrodes;

(j) a socket formed on said rearward portion of said projectile; said socket receiving and surrounding said plug;

(k) third and fourth annular contacts carried by said socket and being in electric contact with said first and second contacts, respectively; and (l) third and fourth conductors extending in said projectile and connecting said third and fourth contacts, respectively, with said projectile fuze.

7. The projectile as defined in claim 6, wherein said socket is conical.

8. The projectile as defined in claim 6, wherein said socket is of a synthetic material.

9. The projectile as defined in claim 6, wherein said first and second contacts are annular.

* * * * *